US007137831B2

(12) United States Patent
Okamoto et al.

(10) Patent No.: US 7,137,831 B2
(45) Date of Patent: Nov. 21, 2006

(54) SUBSTRATE HAVING SPIRAL CONTACTORS

(75) Inventors: Taiji Okamoto, Miyagi-ken (JP); Kaoru Soeta, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/076,747

(22) Filed: Mar. 9, 2005

(65) Prior Publication Data

US 2005/0208811 A1 Sep. 22, 2005

(30) Foreign Application Priority Data

Mar. 16, 2004 (JP) ..... 2004-073781

(51) Int. Cl.
*H01R 12/00* (2006.01)

(52) U.S. Cl. ..... 439/82; 439/66; 439/71

(58) Field of Classification Search ..... 439/66, 439/70–71, 82
See application file for complete search history.

(56) References Cited

U.S. PATENT DOCUMENTS

| | | | | |
|---|---|---|---|---|
| 5,802,699 | A * | 9/1998 | Fjelstad et al. | 29/593 |
| 6,200,143 | B1 * | 3/2001 | Haba et al. | 439/70 |
| 6,437,591 | B1 * | 8/2002 | Farnworth et al. | 324/765 |
| 6,504,223 | B1 * | 1/2003 | Zhou et al. | 257/503 |
| 6,517,362 | B1 * | 2/2003 | Hirai et al. | 439/82 |
| 6,551,112 | B1 * | 4/2003 | Li et al. | 439/66 |
| 6,627,092 | B1 * | 9/2003 | Clements et al. | 216/13 |
| 6,821,129 | B1 * | 11/2004 | Tsuchiya | 439/66 |

FOREIGN PATENT DOCUMENTS

JP 7-335344 12/1995

* cited by examiner

*Primary Examiner*—Michael C. Zarroli
(74) *Attorney, Agent, or Firm*—Beyer, Weaver & Thomas LLP.

(57) ABSTRACT

A substrate is formed with a plurality of spiral contactors on an upper surface serving as a first surface and a plurality of connecting terminals on a lower surface serving as a second surface. Since the spiral contactors are arranged in a matrix on the upper surface serving as the first surface, a lot of spiral contactors can be provided on the substrate of the present invention, and a mount area can be enlarged, and the size of the connector can be decreased.

4 Claims, 9 Drawing Sheets

SUBSTRATE HAVING SPIRAL CONTACTORS

BACKGROUND OF THE INVENTION

1. Field of the Invention

The present invention relates to a substrate mounted in a connector for connecting a circuit board such as a flexible printed wiring board with other electric circuit, and in particular, to a substrate with a large mount area whose size can be reduced, and in which the length of cable can be elongated, thereby a high-frequency characteristic can be satisfactorily obtained.

2. Description of the Related Art

In FIGS. 1 to 7 of Japanese Unexamined Patent Application Publication No. 7-335342 illustrated below, a connector for connecting a flexible conductor such as a flexible printed wiring board etc. with a printed substrate serving as a circuit board is described. The connector described in Japanese Unexamined Patent Application Publication No. 7-335342 comprises substantially U-shaped contact pins; and a housing that is provided on the printed substrate serving as a circuit board and has the contact pins mounted thereon. A plurality of contact pins is provided and disposed in the width direction of the housing at predetermined intervals in a row. Each of the contact pins is formed with a contact point extending in the upper direction of the housing and a terminal portion extending in the rear direction of the housing. The terminal portion is connected with a circuit surface of the printed substrate by soldering. Also, the housing is formed with a jack that includes a dome-shaped housing-receiving portion formed on its upper portion.

On the other hand, the front end of the flexible conductor is formed with a plug-in end portion to which a reinforcing plate is attached, and a conduction circuit is exposed on the rear surface of the plug-in end portion.

In the connector described in Japanese Unexamined Patent Application Publication No. 7-335342, the plug-in end portion of the flexible conductor is inserted into and fitted with the jack formed on the housing, and the housing-receiving portion directly or indirectly presses the upper surface of the plug-in end portion. In this case, a contacting protrusion formed at the side of the jack hunches over the plug-in end portion, and the plug-in end portion is locked in the jack.

When the plug-in end portion is fitted with and locked in the jack, the housing-receiving portion presses the upper surface of the plug-in end portion, thereby the plug-in end portion is reliably locked in the jack, and the contact point formed in the contact pin is pressed to contact with the conductor circuit exposed on the rear surface of the plug-in end portion, thereby the electrical contact between the flexible conductor and the connector can be satisfactorily obtained.

As described above, when the flexible conductor is connected with the connector, a cable way is formed from the flexible conductor to the circuit surface of the printed substrate through the contact point and the terminal portion of the contact pin.

SUMMARY OF THE INVENTION

However, in the connector described in Japanese Unexamined Patent Application Publication No. 7-335342, the contact pins serving as the connecting terminals between the flexible conductor and the circuit board are disposed in the width direction of the housing only in a row. Therefore, the size of the connector is required to be large in order to provide a lot of contact pins, and limited is a method that the number of the connecting terminals (contact pins) can be increased while a predetermined size of the connector is maintained.

In addition, in the connector described in Japanese Unexamined Patent Application Publication No. 7-335342, since the front end portion of the flexible conductor, that is, the plug-in end portion is pressed by the housing-receiving portion, the housing-receiving portion is formed so as to be disposed above the plug-in end portion. As a result, the thickness of the connector increases as much as the thickness of the housing-receiving portion.

Therefore, the size of the entire connector can not be decreased while the number of the contact pins serving as connecting terminals is increased, the flexible conductor is locked reliably and the connection between the flexible conductor and the contact pins that become connecting terminals is satisfactorily maintained.

In addition, since the contact pin is substantially U-shaped, the distance from the contact point, that is a connection point with the flexible conductor, to the terminal portion that is a contact point with the circuit board is long. Therefore, the length of the cable run in the connector becomes long, and it is possible to satisfactorily maintain a high-frequency characteristic.

The present invention is devised to solve the conventional problems described above, and it is an object of the present invention to provide a connector with a large mount area, whose size can be decreased, and whose high-frequency characteristic can be satisfactorily obtained.

The substrate of the present invention is a substrate mounted in a connector connecting a wiring board and a circuit board, comprising a plurality of spiral contactors arranged in a matrix on a first surface in plan view and a plurality of connecting terminals electrically connected with the circuit board formed on a second surface, in which the spiral contactors are electrically connected with the connecting terminals.

The substrate of the present invention is a substrate for a connector electrically connected with a circuit board located outside the connector. It is located between the wiring board and the circuit board constituting the connector to connect the both electrically. The substrate of the present invention is formed with a plurality of the spiral contactors on the upper surface serving as the first surface and connecting terminals electrically connected with the spiral contactors on the lower surface serving as the second surface. Also, the spiral contactors contact with an external connecting portion formed on the wiring board to be connected with it electrically, and the connecting terminals are electrically connected with the circuit board located outside the connector. Therefore the wiring board is electrically connected with the circuit board through the connector including the substrate.

A plurality of the spiral contactors and the connecting terminals are arranged in a matrix on the substrate in plan view. Therefore a lot of the contactors and the connecting terminals can be formed. Therefore, the mount area can be enlarged, and practically, the size of the connector including the substrate of the present invention can be reduced.

In addition, in the substrate of the present invention, since an electric current supplied from the wiring board flows from the spiral contactors formed on the upper surface of the substrate to the connecting terminals formed on the lower surface of the substrate, it is not required for a conduction path to be formed on the upper surface on which the spiral contactors are formed to guide the current flow flown out from the spiral contactors. Therefore short circuit can be prevented easily, and the connector can be easily manufactured.

In this case, a plurality of the connecting terminals can be arranged in a matrix on the second surface in plan view.

With this configuration, a lot of the connecting terminals connected with the circuit board can be provided, and thus the mount area can be decreased.

In addition, the substrate can have a through-hole communicating the first surface and the second surface, in which the spiral contactors are formed on the upper end and the connecting terminals are formed on the lower end.

In this case, the inner surface of the through-hole can be formed with a conduction portion, through which the spiral contactors are electrically connected with the connecting terminals.

In addition, the spiral contactors may be conical shapes that protrude upwardly.

When the spiral contactors are conical protruding upward and the surface of the external connecting portion formed on the wiring board is formed flat, the electric connection between the spiral contactors and the external connecting portion can be satisfactorily obtained. Also, the spiral contactors may be formed flat.

When the spiral contactors are flat and the surface of the external connecting portion of the wiring board is conical shaped that protruds downwardly, the electric connection between the spiral contactors and the external connecting portion can be satisfactorily obtained.

In addition, the connecting terminals can be formed by coating.

As described above, if formed by coating, the connecting terminals can be easily manufactured.

In this case, it is preferable that the inside of the through-hole be filled with filling materials and the lower surface of the filling materials and the second surface of the substrate have the same planarizing layer.

As described above, if the lower surface of the filling materials and the second surface of the substrate have the same planarizing layer, the connecting terminals can be easily formed.

In the substrate of the present invention, a plurality of contactors is disposed flat in a matrix on the upper surface (the first surface). In addition, a plurality of connecting terminals is disposed flat in a matrix on the lower surface (the second surface).

Therefore, in the substrate of the present invention, a lot of contactors can be provided, and the mount area can be enlarged. Therefore the size of the connector using the substrate of the present invention can be reduced substantially.

In addition, in the substrate of the present invention, since an electric current supplied from the wiring board flows from the contactors formed on the upper surface of the substrate to the connecting terminals formed on the lower surface of the substrate through the conduction portion, it is not required for a conduction path to be formed on the upper surface of the substrate on which the contactors are formed to guide the electric current flown out from the contactors. Therefore short circuit can be prevented easily, and the connector can be manufactured easily.

DESCRIPTION OF THE PREFERRED EMBODIMENTS

Figure 1:
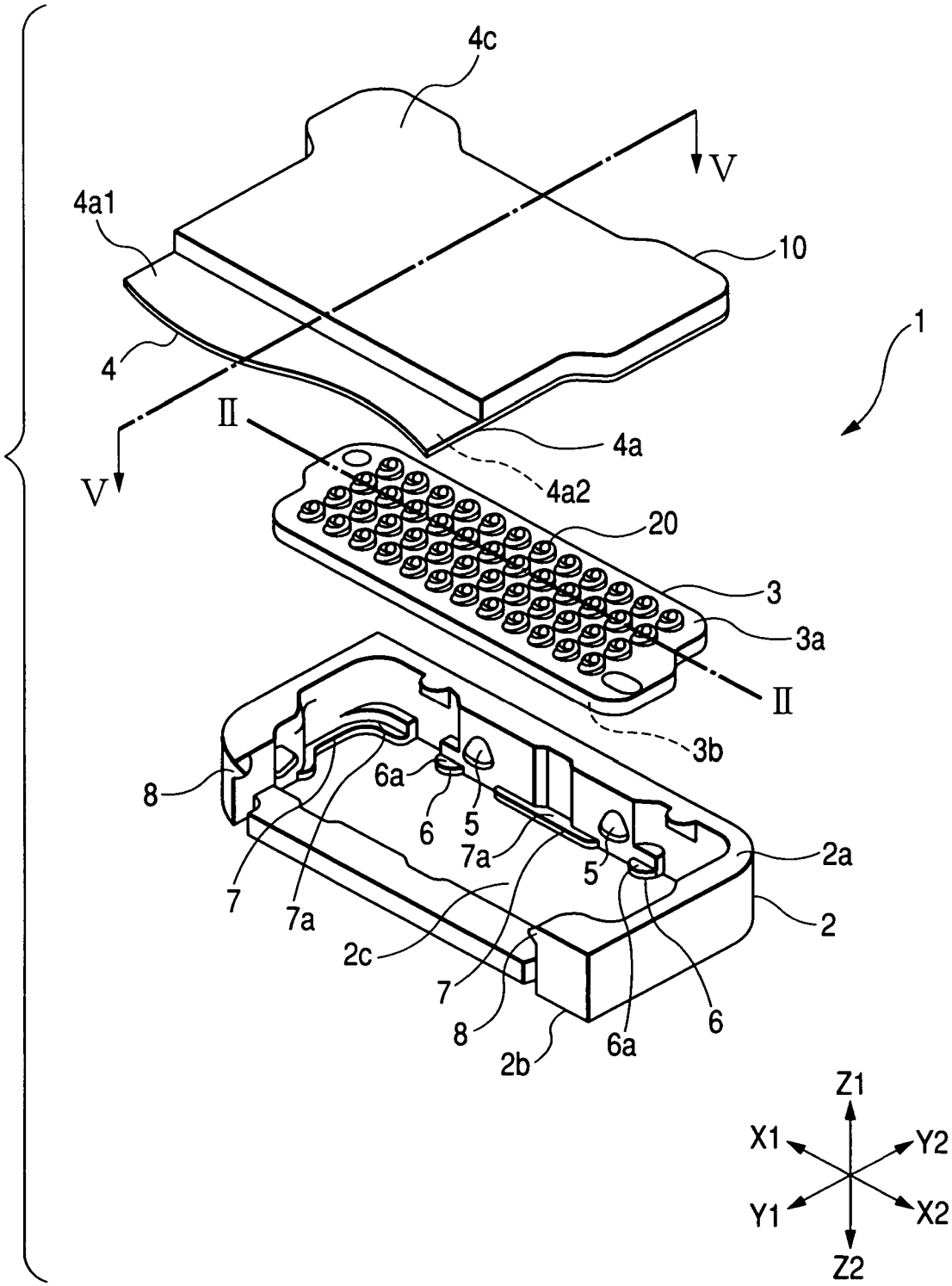
FIG. 1 is an exploded perspective view illustrating a connector of a first embodiment of the present invention.

FIG. 1 is an exploded perspective view illustrating a connector using a substrate of a first embodiment of the present invention. The connector 1 illustrated in FIG. 1 is a face-to-face type connector in which an external connecting portion forming surface of the wiring board face the contactors forming surface of the substrate, which will be described later, thereby the external connecting portions formed on the wiring board are electrically connected with the contactors formed on the substrate.

The connector 1 comprises a housing 2; a substrate 3 according to the present invention; a flexible wiring board 4 that is an wiring board of the present invention; and a fitting member 10 to which the flexible wiring board 4 is fixed.

As shown in FIG. 1, the housing 2 is formed with a fitting portion 2*c* communicating an upper surface 2*a* that is a first surface (a surface of the Z1 direction in the drawing) and a lower surface 2*b* that is a second surface (a surface of the Z2 direction in drawing).

Figure 2:
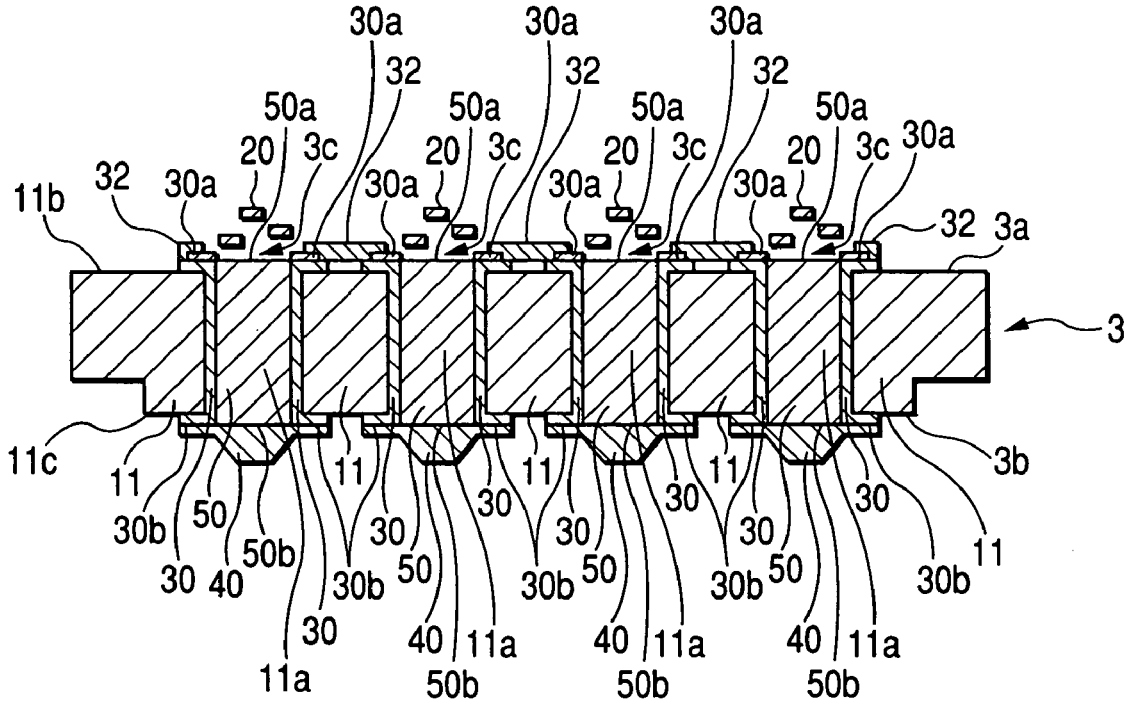
FIG. 2 is a sectional view of the substrate taken along the line II—II of FIG. 1.
Figure 3:
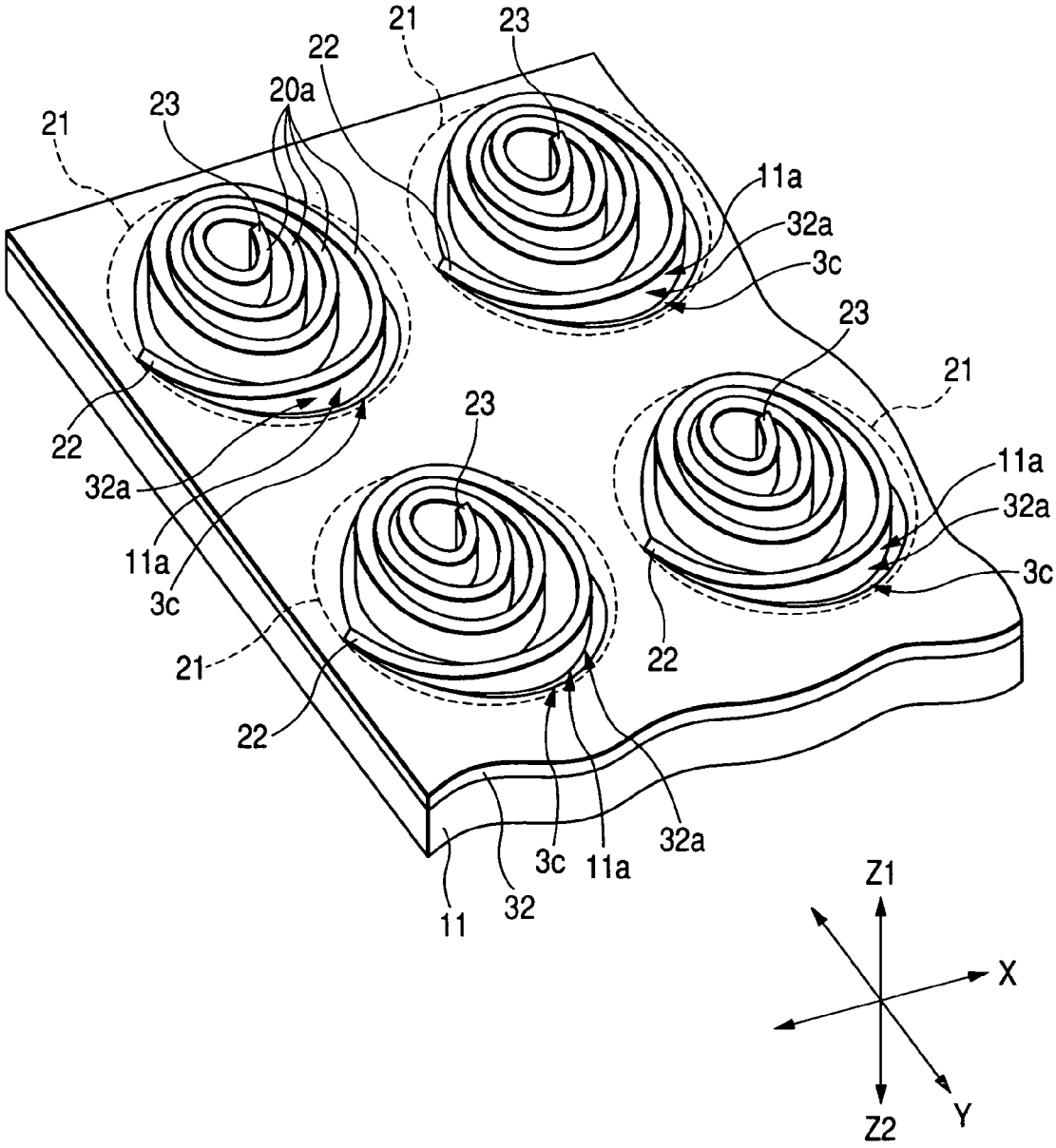
FIG. 3 is an enlarged perspective view illustrating the configuration of a contact terminal of the present invention.

The substrate 3 includes an upper surface 3*a* that is a first surface and a lower surface 3*b* that is a second surface. FIG. 2 is a sectional view of the substrate 3 taken along the line II—II of FIG. 1. As shown in FIGS. 1 and 2, the upper surface 3*a* of the substrate 3 is formed with a plurality of spiral contactors 20 that are the contactors of the present invention. FIG. 3 is a perspective view of the spiral contactors 20. As shown in FIG. 3, a plurality of the spiral contactors 20 is formed in the X and Y directions of the drawing at predetermined intervals on an upper surface 11*b* of a base 11. The spiral contactors 20 are curlicued and disposed in the X and Y directions of drawing at predetermined intervals in a matrix (in a lattice or in a grid shape) in plan view on the upper surface 3*a*.

As shown in FIG. 2, the base 11 is formed with a through-hole 11*a* communicating the upper surface 11*b* and a lower surface 11*c*. Also, the inner surface of the through-hole 11*a* is formed with a conduction portion 30 made of conductive materials.

In addition, the base 11 can be manufactured by mixing, for example, a glass fiber with an epoxy resin.

Each of the spiral contact terminal 20 has a base portion 21, and a swirl-start end 22 provided at the base portion 21. Also, the swirl extends from the swirl-start end 22 so as to form a swirl-termination end 23.

Each spiral contact terminal 20 shown in FIG. 3 is formed in a conical shape which protrudes upwardly (in the Z1 direction in drawing), thereby the vicinity of the swirl-termination end 23 protrudes uppermost.

The spiral contact terminal 20 can be made of materials such as Cu, Ni, Au, etc. and may be constructed with a single layer of the materials or a lamination of the plural layers of the materials such as a lamination of Cu and Ni or a lamination of Ni and Au, etc. Also, the spiral contact terminal 20 can be manufactured by coating the materials.

Each base portion 21 of the spiral contact terminal 20 is joined to each other by a bonding member 32. The bonding member 32 is provided with a through-hole 32*a* that is a little larger than the spiral contact terminal 20. The bonding member 32 is adhered to the base 21 of the spiral contact terminal 20 with the through-hole 32*a* placed on the spiral contact terminal 20. The bonding member 32 can be made of, for example, polyamide etc.

As shown in FIG. 2, an upper end 30*a* of the conduction portion 30 is bonded with the base portion 21 of the spiral contact terminal 20 by a bonding means such as conductive adhesives. In this case, the through-hole 11*a* and the through-hole 32*a* are bonded so as to face to each other, thereby a through-hole 3*c* is formed between the through-hole 11*a* and the through-hole 32*a*. In addition, the swirl-termination end 23 is located in the center of the through-hole 11*a*.

The lower end of the through-hole 11*a* is blocked by the connecting terminal 40 connected with the conduction portion 30. Since each connecting terminal 40 faces the spiral contact terminal 20 with the through-hole 11*a* there between, the connecting terminals 40 are disposed in a matrix (in a lattice or in a grid shape) in plan view at predetermined intervals in the X and Y directions of drawing on the lower surface 3*b*.

The connecting terminals 40 can be made with materials such as Cu, Ni and Au, and may be formed with a single layer of the materials or a lamination of plural layers of the materials such as a lamination of Cu and Ni or a lamination of Ni and Au, etc. Also, the connecting terminals can be made by coating the materials directly on a lower surface 11*c* of the base 11. Also, the connecting terminals 40 previously manufactured may be adhered to the lower surface 11*c* of the base 11.

In this case, the upper end 30*a* of the conduction portion 30 constitutes the upper surface 3*a* of the substrate 3, and the lower end 30*b* constitutes the lower surface 3*b* of the substrate 3.

It is preferable that the through-hole 11*a* be filled with filling materials 50 such as resin materials and a lower surface 50*b* of the filling materials 50 and the lower end 30*b* of the conduction portion 30 be formed as the same planarizing layer. Like this, if the through-hole 11*a* is filled with the filling materials 50 to form the planarizing layer, it becomes easy for the connecting terminals 40 to be formed on the lower surface 11*c* of the base 11 to contact with the lower end 30*b* of the conduction portion 30. Also, it is preferable that the upper end 30*a* of the conduction portion 30 and the upper surface 50*a* of the filling materials 50 form the same planarizing layer. If the conduction portion 30 is constructed as described above, the upper end 30*a* of the conduction portion 30 can easily be bonded with the base 21 of the spiral contact terminal 20.

The flexible printed wiring board 4 has a plastic sheet 4*a* having a plasticity. The plastic sheet 4*a* has a plurality of conduction cables (not shown) constituting a circuit on its upper surface 4*a*1 that is a first surface, and the front-end area of the upper surface 4*a*1 is fixed to the fitting member 10. FIG. 1 is an exploded perspective view of the flexible printed wiring board 4 seen from the upper side 4*a*1 of the plastic sheet 4*a*, and FIG. 4 is an exploded perspective view seen from the lower side 4*a*2 of the plastic sheet 4*a*.

Figure 4:
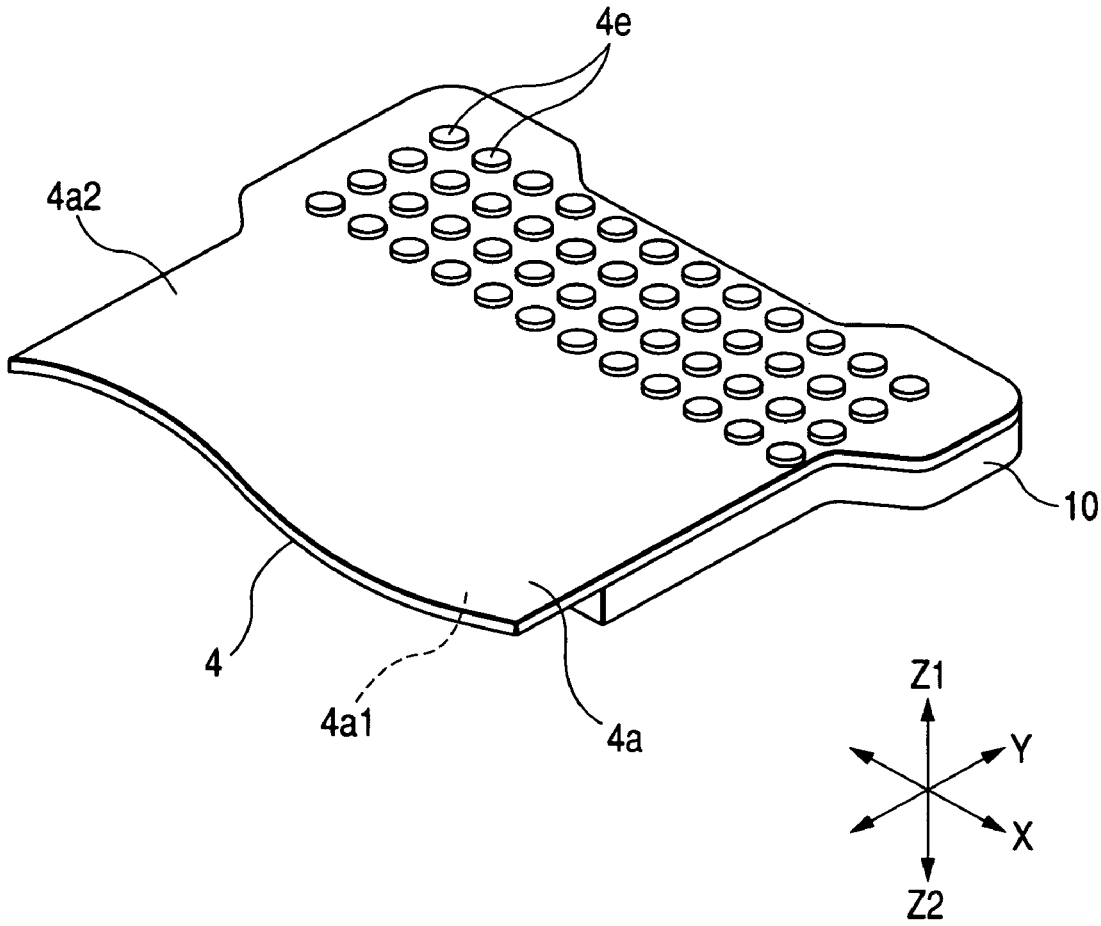
FIG. 4 is an exploded perspective view of a wiring board of FIG. 1 as seen from the rear.

As shown in FIG. 4, the lower surface 4*a*2 is formed with a plurality of external connecting portions 4*e* electrically connected with the conduction cable respectively. The external conduction portion 4*e* is made of electric conductors.

The fitting member 10 is formed by mixing, for example, epoxy resins and glass fibers, the thickness thereof is 200 to 800 μm, thereby, for example, the thickness is 500 μm. Meanwhile, the thickness of the plastic sheet 4*a* is, for example, 0.1 to 0.2 μm.

As shown in FIG. 4, the external connecting portions 4*e* are disposed in a matrix (in a lattice or in a grid shape) in plan view at predetermined intervals in the X and Y directions of drawing on the lower surface 4*a*2 of the plastic sheet 4*a*.

Figure 6:
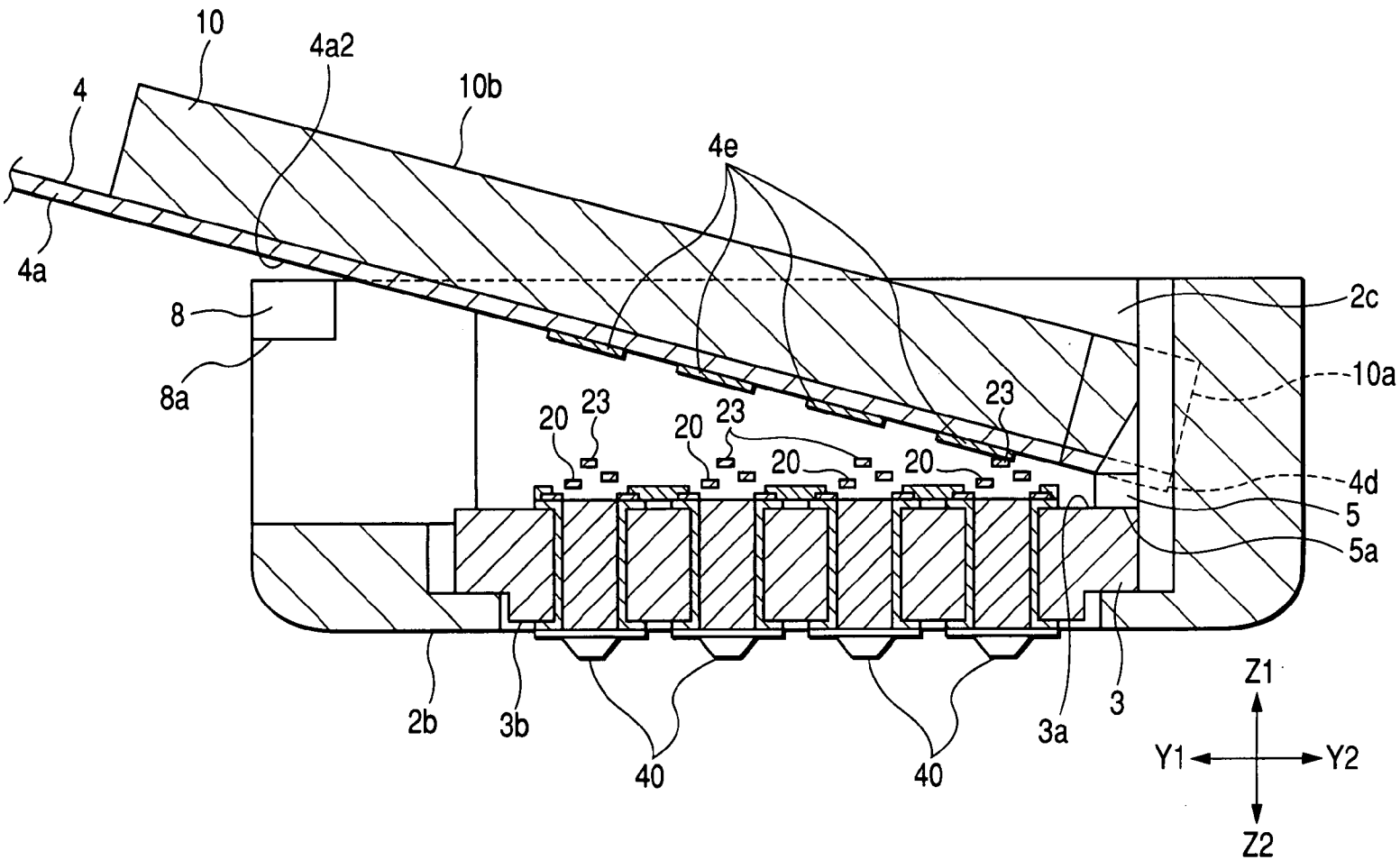
FIG. 6 is a sectional view illustrating another using method of the connector illustrated in FIG. 1.
Figure 7:
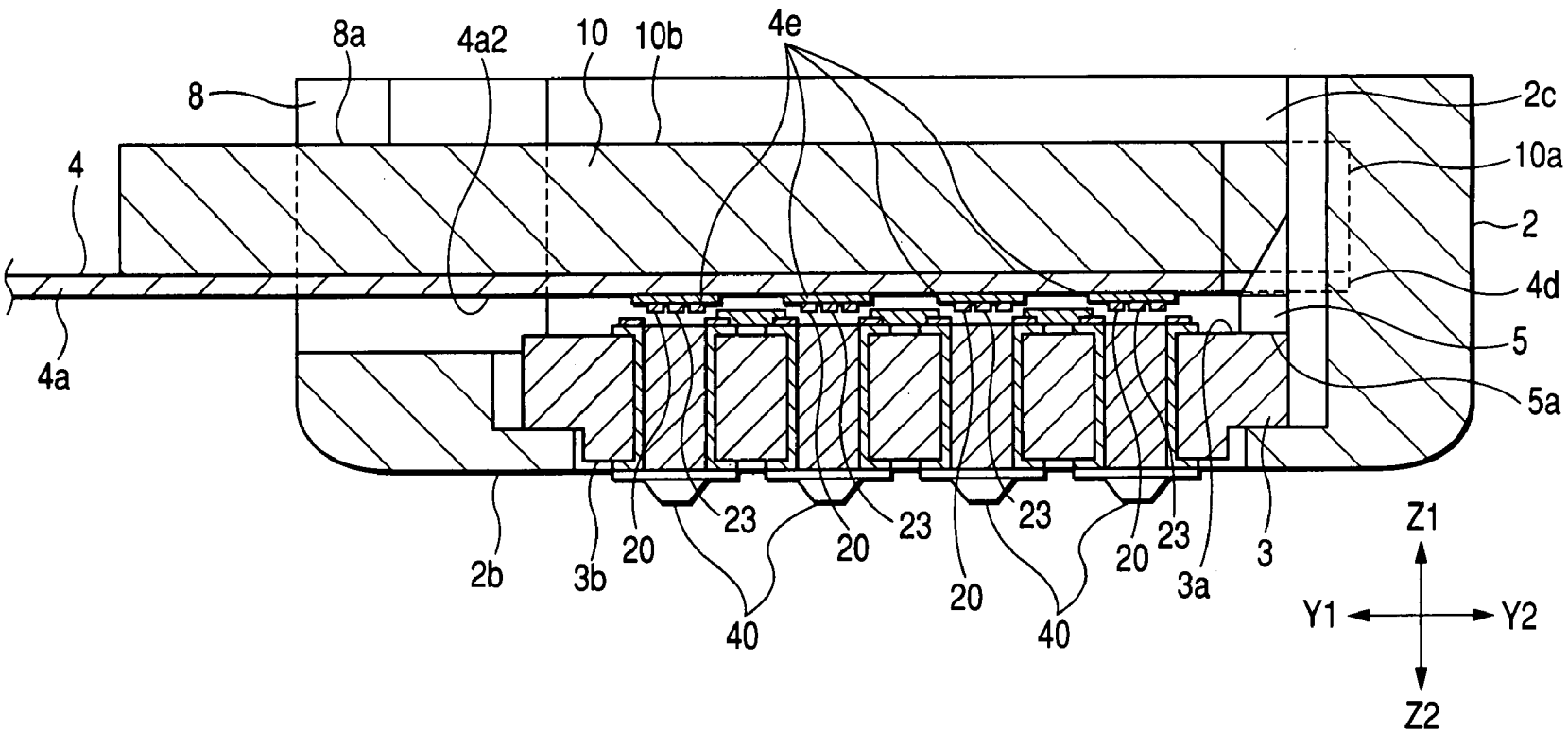
FIG. 7 is a sectional view illustrating still another using method of the connector illustrated in FIG. 1.

The connector 1 is used in a state that the substrate 3 is inserted into to be fitted with the fitting portion 2*c* of the housing 2 and the flexible printed wiring board 4 is loaded on the substrate 3 to be fitted with the fitting portion 2*c* and then locked in the housing 2. Hereinafter this state will be described with reference to FIGS. 5 to 7. Meanwhile, FIGS. 5 to 7 are sectional views taken along the line V—V of FIG. 1.

Figure 5:
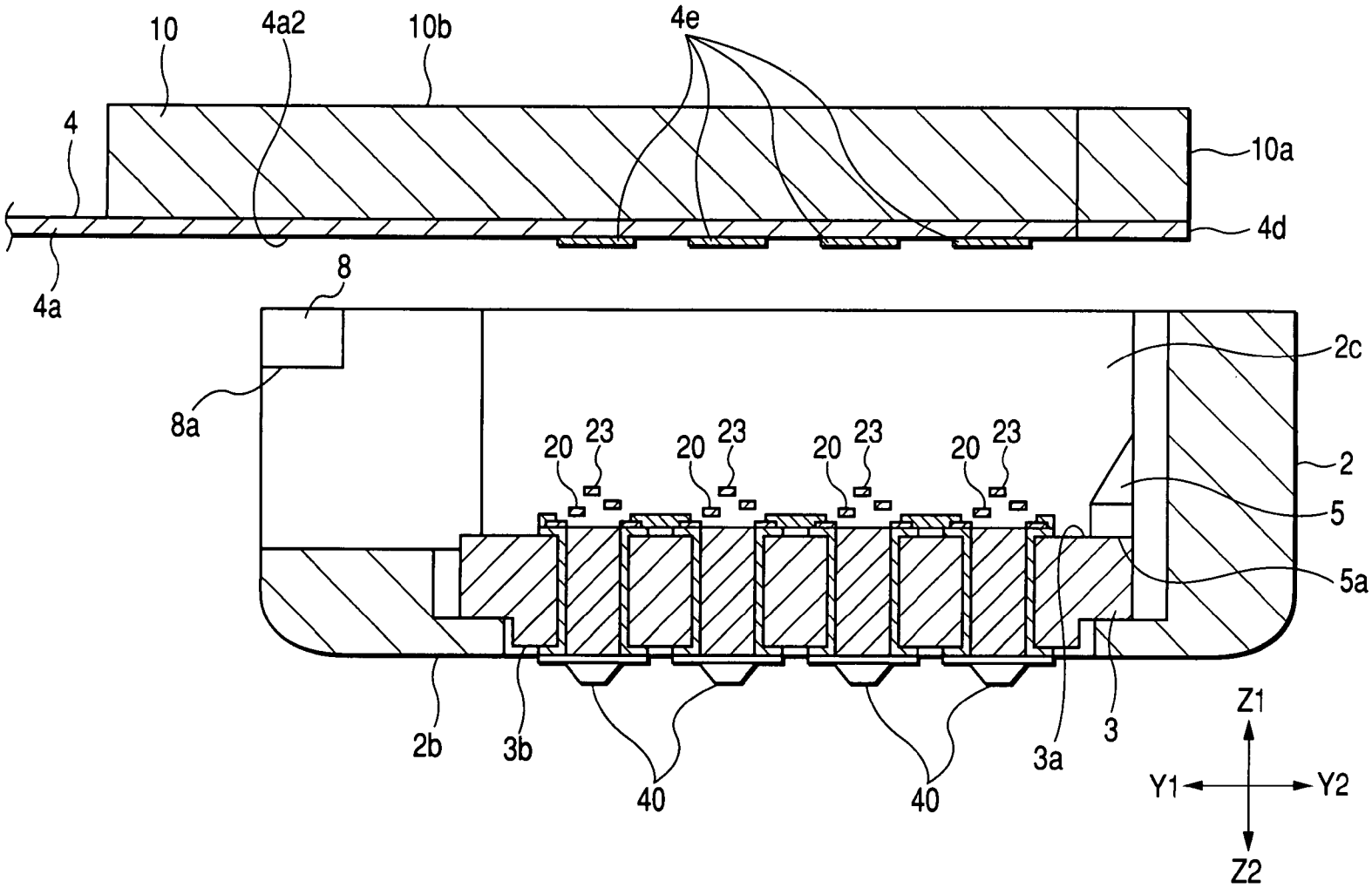
FIG. 5 is a sectional view illustrating a using method of the connector illustrated in FIG. 1.

As shown in FIG. 5, the substrate 3 is inserted into and fitted with the fitting portion 2*c* formed in the housing 2 while the spiral contact terminal 30 of the substrate 3 face upwardly (the Z1 direction in drawing).

As shown in FIG. 1, a first locking protrusion 5 serving as a first locking means, a second locking protrusion 6 serving as a second locking means and a third locking protrusion 7 serving as a third locking means are formed in the fitting portion 2*c*.

When the substrate 3 is inserted into the fitting portion 2*c*, the substrate 3 is loaded on the second locking protrusion and the third locking protrusion in a state when the lower surface 3*b* of the substrate 3 contacts with a locking surface 6*a* of the second locking protrusion 6 and a locking surface 7*a* of the third locking protrusion 7. On the other hand, the upper surface 3*a* of the substrate 3 contacts with a locking surface 5*a* of the first locking protrusion 5, and the upper surface 3*a* of the substrate 3 is pressed by the locking surface 5*a* of the first locking protrusion 5, and then the substrate 3 is locked in the housing 2. Therefore the substrate 3 does not deviate in the fitting portion 2*c*, and it is locked reliably in the housing 2.

At this time, the plane shape of the substrate 3 is the same as that of the fitting portion 2*c*, thereby the substrate 3 does not deviate and is fitted with the fitting portion 2*c*.

As shown in FIG. 5, when the substrate 3 is locked in the housing 2, the connecting terminals 40 formed on the substrate 3 protrudes downward (in the Z2 direction in FIG. 5) to be lower than the lower surface 2*b* of the housing 2.

Next, as shown in FIG. 6, the flexible printed wiring board 4 and the fitting member 10 are inserted into the fitting portion 2*c* of the housing 2 from front ends 4*d* and 10*a* those of while the external connecting portion 4*e* faces downward (in the Z2 direction in drawing). Then the fitting member 10 fixed to the flexible printed wiring board 4 is loaded on the substrate 3 locked in the fitting portion 2*c* and fitted with the fitting portion 2*c*. In this case, the lower surface 4*c* of the flexible printed wiring board 4 is collided with a fourth locking protrusion formed in the housing 2, which is a fourth locking means. However, if the fitting member 10 is further pushed down (in the Z2 direction in drawing), the fourth locking protrusion 8 is transformed elastically to the outside, and then the fitting member 10 moves down under the fourth locking protrusion 8.

Figure 8:
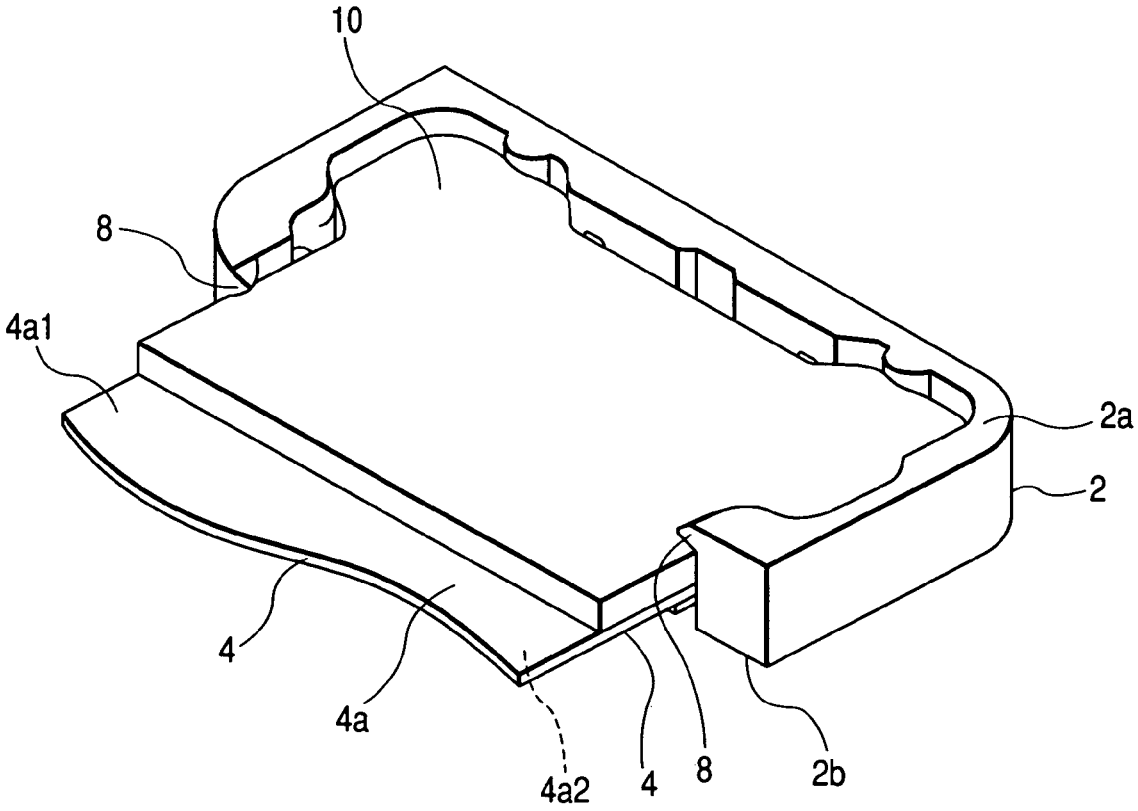
FIG. 8 is a perspective view illustrating still another using state of the connector illustrated in FIG. 1.

At this time, the fourth locking protrusion 8 transformed elastically to the outside is restored to the former state, and the upper surface 10*b* of the fitting member 10 is pressed by a locking surface 8*a* of the fourth locking protrusion 8. And then the flexible printed wiring board 4 is locked in the housing 2. FIG. 7 shows this state, and FIG. 8 is a view illustrating this state from the inclined upper side of FIG. 7.

As shown in FIG. 7, when the substrate 3 and the flexible printed wiring board 4 are locked in the fitting portion 2*c* of the housing 2, the spiral contactors 20 formed on the substrate 3 face and contact with the external connecting portion 4*e* formed on the fitting member 10 of the flexible printed wiring board 4, and then the both can be connected with each other electrically. In this case, since the spiral contactors 20 are shaped like a mountain protruding upward, when contacting with the external connecting portions 4*e*, the spiral contactors 20 are transformed elastically, and the swirl-termination end 23 is pushed down in the Z2 direction of drawing to make the spiral contactors flat. The spiral contactors 20 are in touch with and electrically connected with the external connecting portion 4*e* while elastically pushed down by the external connecting portion 4*e*. Therefore the spiral contactors 20 can reliably contact with the external connecting portion 4*e*, and the electrical connection between the both can be satisfactorily performed.

In addition, in a state of FIG. 7, the upper surface 10*b* of the fitting member 10 is constructed lower than the upper surface 2*a* of the housing 2.

Since the connecting terminals 40 formed on the lower surface 3*b* of the substrate 3 protrude from the lower surface 2*b* of the housing 2, the connecting terminals 40 can electrically be connected with external members (not shown) such as other electric circuit located under the housing 2. Since the connecting terminals 40 are electrically connected with the external members, the flexible printed wiring board 4 is electrically connected with the external members through the substrate 3.

In the connector 1 of the present invention, a plurality of spiral contactors 20 is arranged flat in a matrix on the upper surface 3*a* of the substrate 3 in plan view. Also, a plurality of external connecting portions 4*e* formed on the lower surface 4*a*2 of the plastic sheet 4 of the flexible printed wiring board is arranged flat in a matrix on the lower surface 4*a*2 in plan view. Therefore, in the connector 1 of the present invention, a lot of spiral contactors 20 and external connecting portions 4*e* facing and electrically connected with the spiral contactors 20 can be provided, and the mount area can be enlarged. Therefore the size of the connector 1 can be reduced.

In addition, since the connecting terminals 40 are disposed in a matrix (in a lattice or in a grid shape) on the lower surface 3*b*, a lot of connecting terminals connected with the external members (not shown) can be provided, and the mount area can be decreased.

In addition, in the connector 1 of the present invention, an electric current supplied from the flexible printed wiring board 4 flows to the connecting terminals 20 formed on the lower surface of the substrate 3 from the spiral contactors 20 formed on the upper surface 3*a* of the substrate 3 through the conduction portion 30. That is, since an electric current flown from the spiral contactors 20 formed on the upper surface 3*a* flows to the lower surface 3*b* that is the opposite surface to the upper surface 3*a*, it is not required for a conduction path for guiding the electric current flown out from the spiral contactors 20 to be formed on the surface on which the spiral contactors are formed (the upper surface 3*a*). Therefore short-circuit can be prevented easily, and the connector can be easily manufactured.

In addition, since the flexible printed wiring board 4 is inserted into the fitting portion 2*c* of the housing 2 from the upper portion, and the upper surface 10*b* of the fitting portion 10 is formed lower than the upper surface 2*a* of the housing 2 when the fitting portion 10 to which the flexible printed wiring board 4 is fixed is inserted into to be fitted with the fitting portion 2*c* of the housing 2, the entire connector 1 can be slimmer.

Further, when pushed down by the external connecting portion 4*e* and elastically transformed, the spiral contact terminal 20 is elastically transformed from a protruded shape into a plane shape. In this case, the external connecting portion 4*e* contacts with the swirl-start end 22, not the swirl-termination end 23, of the spiral contact terminal 20, that is, outskirt portion, which is the base portion 21. Therefore the length of cable through which an electric current flows between the flexible printed wiring board 4 and the substrate 3 can be shortened, and the electric resistance can be decreased, and the high-frequency characteristic can be satisfactorily obtained.

Figure 9:
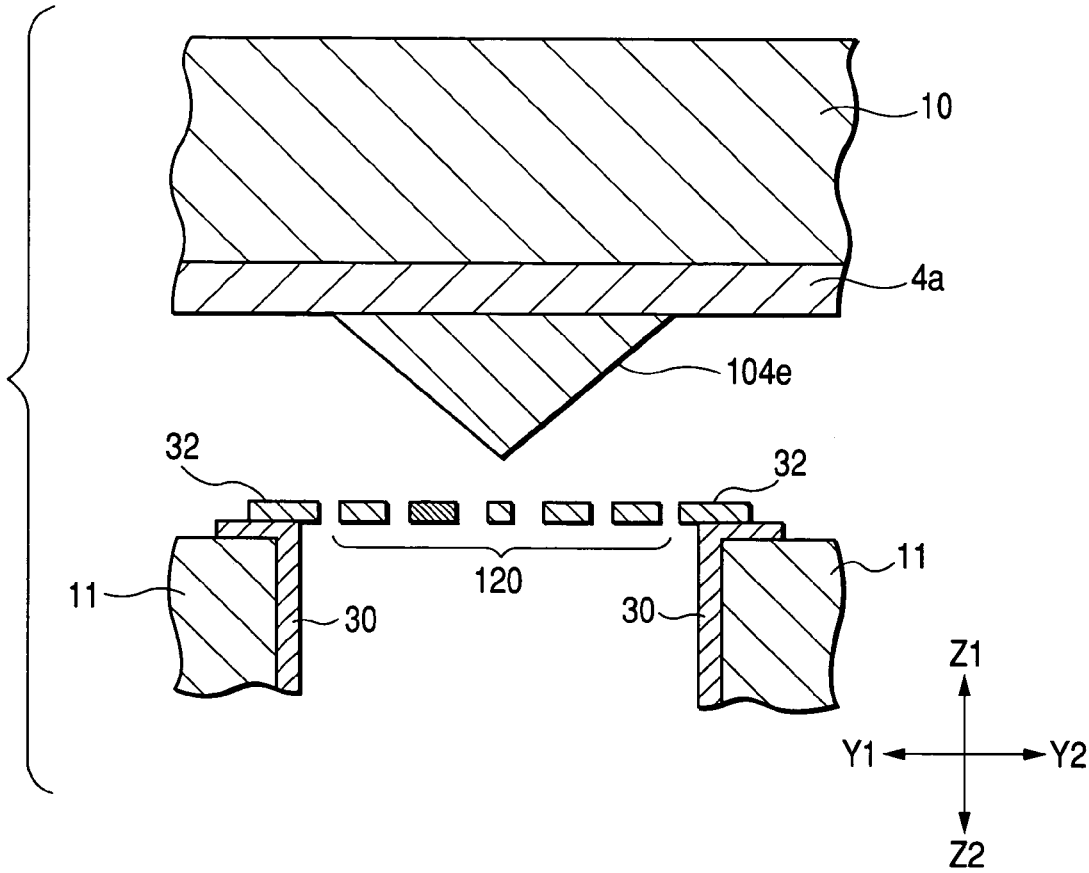
FIG. 9 is a partial sectional view for explaining a connector using a substrate of a second embodiment of the present invention.

FIG. 9 is a partial sectional view illustrating a connector 10 of a second embodiment of the present invention. The connector 101 comprises the same components as those of the connector 1 illustrated in FIGS. 1 to 7, and FIG. 9 mainly illustrates the different part of the connector 101 from those of the connector 1.

As shown in FIG. 9, in the connector 101, an external connecting portion 104*e* formed on the fitting member 10, to which a flexible printed wiring board 4 is fixed, protrudes downward (in the Z2 direction of drawing) to be formed in a conical.

On the other hand, in the connector 101, different from the substrate 3 used in the connector 1, a spiral contact terminal 120 formed on the upper surface 103*a* of the substrate 103 that is the present invention is not shaped like a protrusion, instead, is shaped flat throughout the swirl-start end 122 to the swirl-termination end 123.

Figure 10:
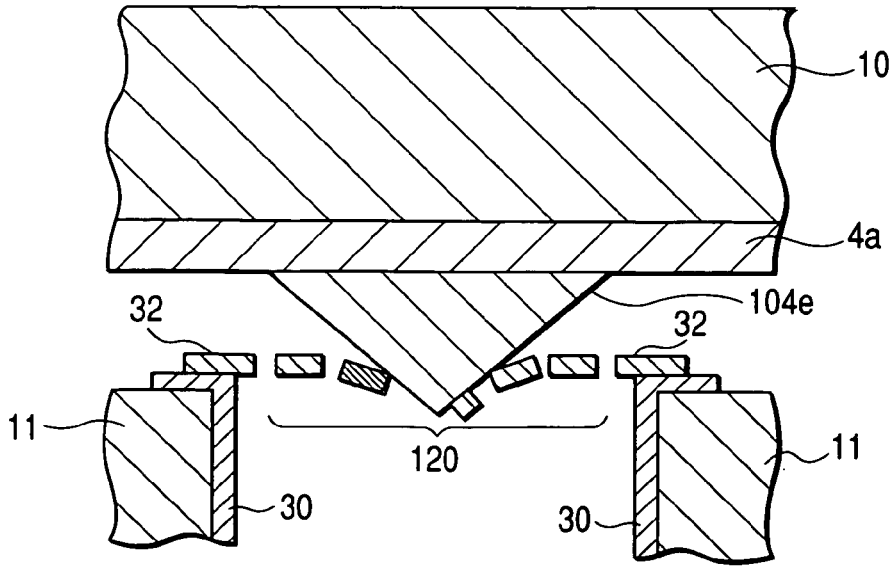
FIG. 10 is a partial sectional view illustrating a using state of the connector illustrated in FIG. 9.

In the connector 101, the external connecting portion 104*e* is formed in a conical that protrudes downward. Therefore, as shown in FIG. 10, it is preferable that the spiral contact terminal 120 formed on the upper surface 3*a* of the substrate 3 be formed flat, since it makes easy for the external connecting portion 104*e* to adhere to the spiral contact terminal 120 closely and the electric connection can be satisfactory.

In addition, in the substrate 103, the spiral contact terminal 120 may be shaped like a mountain protruding upward (in the Z1 direction of drawing) such as the connector 1, however, it is preferable that the spiral contact terminal 120 be formed flat since it will make the electric connection more satisfactory.

In addition, the substrates 3 and 103 of the present invention may be a circuit board such as a flat cable not having a plastic part such as plastic sheet 4*a*, instead of the flexible printed wiring board 4.

What is claimed is:

1. A substrate mounted in a connector connecting a wiring board and a circuit board, comprising:

a plurality of spiral contactors arranged in a matrix on a first surface in plan view; and a plurality of connecting terminals electrically connected with the circuit board and formed on a second surface, wherein the spiral contactors are electrically connected with the connecting terminals, wherein communicating through-holes are formed in the substrate, the spiral contactors protruding outward in conical shapes are formed on the upper end of the through-holes, the connecting terminals are formed on the lower end of the through-holes, the spiral contactors are electrically connected with the connecting terminals through a conduction portion inside the through-holes, and the connecting terminals protrude from a lower surface of a housing, wherein the wiring board and the substrate are configured to be locked for electrical connection in the housing.

2. The substrate according to claim 1, wherein a plurality of the connecting terminals are arranged on the second surface in plan view.

3. The substrate according to claim 1, wherein the connecting terminals are formed by coating.

4. The substrate according to claim 1, wherein the through-holes are filled with filling materials, and lower surfaces of the filling material and the second surface of the substrate form the same planarizing layer.

* * * * *